US009868678B2

(12) United States Patent
Besombes et al.

(10) Patent No.: US 9,868,678 B2
(45) Date of Patent: Jan. 16, 2018

(54) GAS-GENERATING PYROTECHNIC MONOLITHIC BLOCKS

(71) Applicant: HERAKLES, Le Haillan (FR)

(72) Inventors: Stéphane Besombes, Eysines (FR); Frédéric Marlin, Saint Medard en Jalles (FR)

(73) Assignee: AIRBUS SAFRAN LAUNCHERS SAS, Paris (FR)

( * ) Notice: Subject to any disclaimer, the term of this patent is extended or adjusted under 35 U.S.C. 154(b) by 0 days.

(21) Appl. No.: 15/322,905

(22) PCT Filed: Jun. 29, 2015

(86) PCT No.: PCT/FR2015/051753

§ 371 (c)(1),
(2) Date: Dec. 29, 2016

(87) PCT Pub. No.: WO2016/001549

PCT Pub. Date: Jan. 7, 2016

(65) Prior Publication Data

US 2017/0158576 A1 Jun. 8, 2017

(30) Foreign Application Priority Data

Jun. 30, 2014 (FR) ..... 14 56162

(51) Int. Cl.

| | |
|---|---|
| ***C06B 31/00*** | (2006.01) |
| ***D03D 23/00*** | (2006.01) |
| ***D03D 43/00*** | (2006.01) |
| ***C06B 23/00*** | (2006.01) |

(Continued)

(52) U.S. Cl.
CPC ..... *C06B 23/007* (2013.01); *C06B 45/00* (2013.01); *C06D 5/06* (2013.01)

(58) Field of Classification Search
USPC ..... 149/45, 108.4, 109.2, 109.4, 109.6
See application file for complete search history.

(56) References Cited

U.S. PATENT DOCUMENTS 5,682,013 A 10/1997 Smith et al.
2014/0116584 A1* 5/2014 Marlin ..... C06B 23/007 149/2

FOREIGN PATENT DOCUMENTS

| | | |
|---|---|---|
| FR | 2 275 425 A1 | 1/1976 |
| FR | 2 998 174 A1 | 5/2014 |
| FR | 2 999 174 A1 | 6/2014 |

(Continued)

OTHER PUBLICATIONS

International Search Report as issued in International Patent Application No. PCT/FR2015/051753, dated Oct. 9, 2015.

(Continued)

*Primary Examiner* — James McDonough
(74) *Attorney, Agent, or Firm* — Pillsbury Winthrop Shaw Pittman LLP

(57) ABSTRACT

A substantially cylindrical gas-generating pyrotechnical monolithic block has a thickness no lower than 10 mm, an equivalent diameter no lower than 10 mm, and a porosity lower than 5%; and a composition, given as weight percentages, which contains, for at least 94% of the weight thereof: +77.5% to 92.5% of guanidine nitrate, +5% to 10% of basic copper nitrate, and +2.5% to 12.5% of at least one inorganic titanate with a melting temperature higher than 2100 K.

19 Claims, 1 Drawing Sheet

(51) Int. Cl.
*C06B 45/00* (2006.01)
*C06D 5/06* (2006.01)

(56) References Cited

FOREIGN PATENT DOCUMENTS

| | | | |
|---|---|---|---|
| WO | WO 2006/134311 | A2 | 12/2006 |
| WO | WO 2007/113299 | A1 | 10/2007 |
| WO | WO 2008/025930 | A1 | 3/2008 |
| WO | WO 2008/118273 | A2 | 10/2008 |
| WO | WO 2012/153062 | A2 | 11/2012 |

OTHER PUBLICATIONS

Mei, X., et al., "Thermal decomposition properties of guanidine nitrate and basic cupric nitrate," Journal of Thermal Analysis and Calorimetry, Oct. 2013, vol. 114, No. 1, XP002738872, pp. 131-135.

International Preliminary Report on Patentability and the Written Opinion of the International Searching Authority as issued in International Patent Application No. PCT/FR2015/051753, dated Jan. 3, 2017.

* cited by examiner

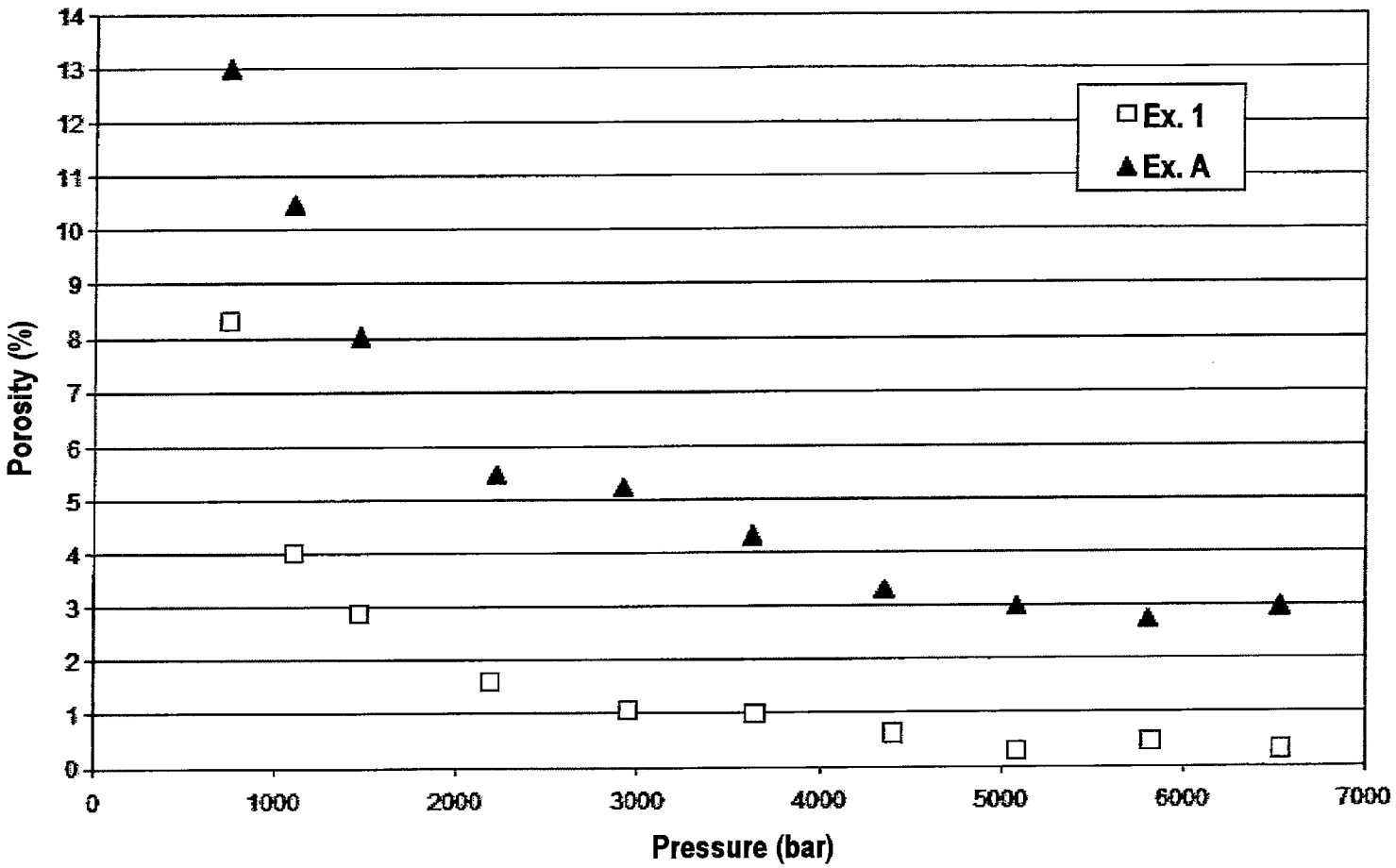
Ex. 1
Ex. A
Porosity (%)
Pressure (bar)
0
1
2
3
4
5
6
7
8
9
10
11
12
13
14
0
1000
2000
3000
4000
5000
6000
7000

GAS-GENERATING PYROTECHNIC MONOLITHIC BLOCKS

CROSS-REFERENCE TO RELATED APPLICATIONS

This is the U.S. National Stage of PCT/FR2015/051753, filed Jun. 29, 2015, which in turn claims priority to French Patent Application No. 1456162, filed Jun. 30, 2014, the entire contents of all applications are incorporated herein by reference in their entireties.

The present invention relates to gas-generating pyrotechnic monolithic blocks ("large" pyrotechnic objects); said blocks being suitable for being integrated in devices dedicated for pressurization of structures of a more or less large volume, depending on the intended application. Said blocks are more particularly suitable for being integrated in devices whose working requires pressurization to be provided over a relatively long period of time, very significantly greater than the periods of time required for the working of gas generators for airbags (times of at most a few milliseconds) and even of gas generators for hood-lifting jacks (times of about 100 milliseconds).

Owing to their intrinsic size, porosity and composition characteristics, the pyrotechnic monolithic blocks of the invention give particularly good performance (with reference to specifications with many stringent requirements). They give particularly good performance notably with respect to their (low) combustion rate and (low) temperature, their ease of production and their gas yield (see below).

The devices in question are, for example, extinguishers (the gases required for their working are used as propellant gas, serving for expelling an extinguishing liquid through a nozzle), actuators of jacks for opening doors in emergency (the gases required for their working are used for operating a jack mechanically), devices for inflating flexible structures (the gases required for their working provide deployment and pressurization of a flexible, impervious envelope). The inflation of these flexible structures may meet various needs: the need for obstruction of a pipeline (for example, for anti-discharge systems, with the aim of limiting the risks of pollution in case of industrial accident), the need to generate flotation bags (for example for emergency ditching, notably of a helicopter), the need to deploy a flexible slide (for example for emergency evacuation of the passengers from an aircraft), for example.

To date, the working of such devices, which are therefore generally safety or emergency devices, is most often provided by the use of a neutral gas (nitrogen, helium, etc.), stored at high pressure (200 to 400 bar) in a tank. This technology has advantages, such as the use of a neutral gas (inert), intrinsically nontoxic and moreover cold. However, as it uses a pre-compressed gas, at high pressure, it has notable disadvantages:

a) the gas storage tanks are still of large dimensions (even though the gas is highly compressed);

b) the presence of gas stored at high pressure in a tank (bottle, etc.) requires, for obvious safety reasons, that said tank is dimensioned observing the rules of the art and the directives with respect to an envelope under pressure so as to withstand the high internal pressure for long periods, which leads to structures either of large thickness (and therefore of considerable weight), or using lightweight materials (composites) with high production cost; finally, c) periodic operations of maintenance are required to guarantee safe, optimal working throughout the service life of the device. These operations obviously affect the operating costs.

Disadvantages a and b above prove particularly critical for on-board devices (notably in the aeronautical sector, in view of the constraints imposed there in terms of weight and/or dimensions). Elimination of regular maintenance operations (disadvantage c above) would of course produce a very advantageous decrease in operating costs.

The use of solid pyrotechnic objects for the working of devices of the above type has also been described.

The specifications for the working of such devices require that a volume of gas, at a moderate temperature, is generated, starting from the pyrotechnic objects in question, relatively slowly and constantly, for a relatively long specified duration, for so pressurizing a structure of a more or less large volume (we may mention, not in any way limiting, volumes of about 1 L (jacks for opening doors, for example), about 3000 L (helicopter flotation bags, for example), or even about 20 000 L (evacuation slide, for example)).

Patent application WO 2007/113299 thus describes pyrotechnic objects, intended for generating gas over a relatively long period of time (times from 50 ms to 1 min are mentioned), whose composition, binder-free, contains guanidine nitrate (GN: as reducing charge) and basic copper nitrate (BCN: as oxidizing charge), in a GN/BCN ratio close to the stoichiometric equilibrium. Said composition therefore has an almost equilibrated oxygen balance (close to zero). This endows said pyrotechnic objects with a combustion temperature and a combustion rate that are too high with reference to the specifications presently in question (see below).

The objects described in said application WO 2007/113299, advantageously obtained by a dry compacting method, are of substantially cylindrical shape and have a thickness greater than 5 mm, a diameter greater than or equal to 10 mm (generally thickness and/or diameter between 10 and 60 mm) and porosity between 1 and 8%. In fact, low porosities (<5%, and more advantageously <3%) cannot easily be obtained with the compositions described (and their densification characteristic), except for objects of limited size. Now, a person skilled in the art is aware of the critical nature of this parameter porosity. A "high" porosity value (in this case above 4-5%) is generally of a nature such as to increase the dispersion of ballistic working of the pyrotechnic object, to give said pyrotechnic object insufficient durability in environments with severe vibrations for prolonged periods and, for this class of pyrotechnic compounds (i.e. based on a GN+BCN mixture), to increase the value of the rate of combustion.

Considering their particularly advantageous properties in a context of long-term gas generation, the pyrotechnic monolithic blocks of the invention (described below) may be regarded as improvements to the pyrotechnic objects according to the teaching of application WO 2007/113299.

The inventors propose gas-generating pyrotechnic monolithic blocks whose combustion gases replace the pressurized gases of the prior art, for providing working of safety or emergency devices (more generally for providing pressurization of structures). This substitution, which is advantageous per se (see above for the disadvantages of using gas under pressure), is the more so as said blocks of the invention give particularly high performance, with reference to stringent specifications. In any case, they give better performance than the objects described in application WO 2007/113299.

The main requirements of said specifications are presented below.

In order to deliver, particularly advantageously, a suitable flow rate (flow rate=rate of combustion×surface area undergoing combustion) of combustion gas for a relatively long time (generally at least 500 ms and up to 2 min), the inventors investigated:

- large blocks (typically with a thickness ≥10 mm and an equivalent diameter ≥10 mm), so that their surface area of combustion is reduced (so that they have a large thickness to be burnt); said blocks being able to be produced (formed) densified (i.e. having a low porosity: <5%, advantageously ≤3%, very advantageously ≤2%), with a limited compacting force, which constitutes a real advantage. Such blocks allow charges to be obtained that have a density (the density of a charge corresponding to the weight of pyrotechnic product relative to the charge volume occupied) that is as high as possible (in order to allow a decrease in overall dimensions of the gas generator, which is particularly beneficial in on-board systems, notably intended for the aeronautical sector. Typically, this requirement effectively prohibits the use of charges in the form of pellets in bulk, such as those used conventionally in gas generators for airbags). Inhibition (for example, by deposition of a thermosetting varnish) of the lateral surface of the blocks may moreover be provided to increase the combustion time of the blocks, in contexts where a very long pressurization time is required;
- blocks having a low combustion temperature: less than or equal to 1415 K. Such a low combustion temperature limits the inevitable loss of pressure due to cooling of the gases generated. This low combustion temperature is moreover particularly beneficial with reference to the thermal stresses imposed on the gas generator and on the structure to be pressurized;
- blocks having a low rate of combustion. More precisely, the following are required: 1) a moderate combustion rate at low pressure (combustion must take place at low pressure (this is particularly beneficial with reference to the constraints of pressure resistance of the gas generator (and therefore with reference to the weight of the latter) and of the structure to be pressurized) and its rate is typically below 6 mm/s between 1 and 10 MPa (it will be understood that the combustion rate at high pressure (20 MPa) is potentially above 6 mm/s but said combustion rate at high pressure is not at all relevant here, in view of the desired applications (pressurization of large-volume structures over a long period)); and 2) a nonzero rate at atmospheric pressure (it is desirable for the blocks to burn completely);
- blocks having good characteristics of ignitability and of combustion warm-up;
- blocks generating combustion residues in agglomerated form (residues that are thus easily filterable, advantageously making it possible to reduce the dimensions of the gas filtration systems that have to be incorporated in the device);
- blocks also having good gas yields (generally above 38 mol/kg, in a preferred variant above 42 mol/kg), making it possible to limit the weight of pyrotechnic charge to be incorporated and therefore the weight of the system (this is particularly advantageous for devices intended for the aeronautical market).

With reference to such specifications, the inventors therefore propose gas-generating pyrotechnic monolithic blocks that are original, with particularly good performance, and which are characterized by their size, porosity and composition.

Said gas-generating pyrotechnic monolithic blocks of the invention, of substantially cylindrical shape (generally, but not exclusively, cylinders of revolution or quasi-cylinders of revolution), combine characteristics a) of size: a thickness greater than or equal to 10 mm and an equivalent diameter greater than or equal to 10 mm, b) of porosity: a porosity below 5% (this parameter, expressed in percentage, corresponds to the ratio of the difference between the theoretical density and the actual density to the theoretical density), and, c) of composition: their composition, expressed as percentage by weight, contains, for at least 94% of their weight:

+77.5 to 92.5% of guanidine nitrate (GN),

+5 to 10% of basic copper nitrate (BCN), and

+2.5 to 12.5% of at least one inorganic titanate whose melting point is above 2100 K.

With reference to the size characteristics stated above, it will be understood that the blocks in question consist of large objects. Not in any way limiting, it may be stated here that they generally have a thickness between 10 and 100 mm (10 mm≤e≤100 mm) and/or, very generally and, an equivalent diameter between 10 and 100 mm (10 mm≤Φ≤100 mm). According to an advantageous embodiment, they have a thickness between 20 and 80 mm (20 mm≤e≤80 mm) and/or, preferably and, an equivalent diameter between 20 and 80 mm (20 mm≤Φ≤80 mm).

With reference to the porosity characteristic stated above, it will be understood that the blocks in question are dense blocks. According to an advantageous embodiment, the porosity of said blocks is less than or equal to 3%. According to a very advantageous embodiment, the porosity of said blocks is less than or equal to 2%, or even less than or equal to 1% (a low (≤2%), or even very low (≤1%) value of porosity is obtained (with the compositions of the blocks of the invention) by application of a nominally high compression force, and a porosity value that is less low but is already low (>2% and <5%) is obtained by application of a compression force that is reduced relative to that required for obtaining an equivalent porosity with the compositions according to the teaching of WO 2007/113299 (see the appended FIGURE)).

A person skilled in the art will already understand the great benefit of the blocks of the invention, which combine large size and low porosity. The specific composition of the blocks makes such combination possible and is particularly beneficial with reference to the combustion parameters of said blocks (see the combustion temperature (≤1415 K) and the combustion rates (<6 mm/s between 1 and 10 MPa and nonzero at atmospheric pressure) stated in the specifications above).

The composition of the blocks of the invention is a composition that contains, for at least 94% of its weight:

- the three ingredients identified above: guanidine nitrate (GN) as reducing charge, basic copper nitrate (BCN) as oxidizing charge, and inorganic titanate(s) as refractory charge (the melting point of this charge (>2100 K) is still above the combustion temperature of the base GN+BCN in which it is present (such a base, unbalanced (see below), has a combustion temperature still below about 1500 K)) providing a dual function of agent for agglomeration of the solid combustion residues and of combustion modifier (which makes it possible to reach, unexpectedly, the severe properties of combustion (temperature and combustion rates) that are required);

in the proportions stated: in a GN+BCN base that is highly unbalanced with respect to oxygen balance (owing to its weight ratio GN/BCN≥7.75, advantageously ≥8.5), this imbalance being appropriate with reference to the required combustion properties, the at least one titanate is present, in a significant amount (≥2.5 wt. %, ≥5 wt. % according to one embodiment, so that the technical effect of optimization on the combustion properties that it develops (unexpectedly) is significant) but not excessive (≤12.5 wt. %, quite particularly with reference to the gas yield and ignitability).

With reference to the composition of the blocks of the invention, more particularly the GN+BCN base of said composition, the following may be added.

1) The high content of guanidine nitrate in the compositions of the blocks of the invention (from 77.5 to 92.5 wt. %) is particularly advantageous, with reference to the density (to the low porosity) of said blocks, owing to the rheoplastic behavior of said guanidine nitrate. It is particularly advantageous for implementing step(s) of compacting and/or compression during preparation of said blocks, notably by a dry process (see below).

2) Guanidine nitrate and basic copper nitrate are therefore present in a weight ratio R=GN/BCN (unbalanced) between 7.75 and 18.5 (see the weight ratios stated for GN and BCN). Said weight ratio is advantageously between 8.5 and 15, very advantageously between 8.5 and 12, and especially preferably between 8.5 and 10. These embodiments that are advantageous, very advantageous and particularly preferred are so with reference to the required combustion properties but also with reference to the ignitability and gas yield of the blocks in question.

With reference to the at least one inorganic titanate present in the composition of the blocks of the invention, the following may be added.

Said at least one inorganic titanate is preferably selected from the metal titanates and the alkaline-earth titanates (=the metal titanates, the alkaline-earth titanates and mixtures thereof). The composition of the blocks of the invention thus very advantageously contains a metal titanate or an alkaline-earth titanate. Preferably, the composition of the blocks of the invention contains strontium titanate ($SrTiO_3$, whose melting point is 2353 K) and/or calcium titanate ($CaTiO_3$, whose melting point is 2248 K) and/or aluminum titanate ($Al_2TiO_5$, whose melting point is 2133 K). Especially preferably, it contains strontium titanate ($SrTiO_3$), calcium titanate ($CaTiO_3$) or aluminum titanate ($Al_2TiO_5$).

The dual function of said titanates in the composition of the blocks of the invention should be emphasized. Said titanates perform the role of agglomerating agent of the combustion residues (owing to their refractory nature (melting point >2100 K), they conserve their physical state of pulverulent solid (they are obviously used in this form) at the combustion temperature of the block, hence agglomeration of the copper residues (residues in (wholly or partly) liquid form at the combustion temperature of the composition) generated during combustion of BCN) and, present within a GN+BCN base that is highly unbalanced in oxygen balance, they make it possible to obtain, surprisingly, the specific combustion properties that are required (a combustion temperature less than or equal to 1415 K, a moderate rate of combustion, less than or equal to 6 mm/s, at low pressure (between 1 and 10 MPa) and a nonzero combustion rate at atmospheric pressure), combustion properties that are necessary for the intended functional need of pressurization, over a long time (times from 500 ms to 2 min were stated above), of more or less large volumes (volumes from 1 L to 20 000 L were mentioned above). Their use seems particularly appropriate with reference to the nonzero combustion rate at atmospheric pressure.

The three essential constituents of the blocks of the invention identified above—GN+BCN+at least one inorganic titanate whose melting point is above 2100 K—therefore represent at least 94 wt. % of the total weight of said blocks. They might perfectly well represent at least 97% of the latter, at least 99% of the latter, or even 100% of the latter.

In addition to said three essential constituents of the blocks of the invention, the composition of said blocks may contain other ingredients. It is to be understood that said other ingredients should only be present at most at a rate of 6 wt. % and, obviously, only if their presence does not significantly affect the required properties, quite particularly of combustion. Said other ingredients are, not exclusively, but generally, selected from processing additives (manufacturing aids), binders and fluxes (see below).

According to a first variant, the composition of the blocks of the invention contains, besides said three essential constituents, at least one processing additive (manufacturing aid, consisting for example of calcium stearate or graphite). Said processing additive is generally present at a content not exceeding 1 wt. %. Conventionally it is present at a content not exceeding 0.5 wt. %. Its presence is particularly appropriate for obtaining the blocks of the invention by dry processing (see below).

In the context of this first variant, the composition of the blocks of the invention advantageously comprises 100 wt. % of said guanidine nitrate, basic copper nitrate, at least one inorganic titanate and at least one processing additive. The blocks of the invention that have this advantageous composition are generally obtained by dry processing. However, they may also be obtained by wet processing, quite particularly by wet processing comprising a spraying step (see below).

According to a second variant, the composition of the blocks of the invention contains, besides said three essential constituents (and, optionally, in addition, said at least one processing additive), at least one binder (for example of cellulosic or acrylic type) or at least one flux (for example of the alkali metal chloride salt type, such as NaCl or KCl). The presence of at least one such binder may notably be suitable for obtaining blocks of the invention by extrusion, optionally by a wet method (the binder then contributing to the formation of a gel on contact with the solvent used (water being the preferred "solvent") (see below)); the presence of at least one such flux may notably be suitable for obtaining blocks of the invention by dry processing (see below), quite particularly for obtaining blocks formulated from compositions characterized by a very low combustion temperature. Said at least one such binder or at least one such flux is generally present at a content not exceeding 5 wt. %, very generally present at a content not exceeding 3 wt. %.

In the context of this second variant (and also in that of the first variant above), the composition of the blocks of the invention advantageously comprises 100 wt. % of said guanidine nitrate, basic copper nitrate, at least one inorganic titanate, at least one processing additive and at least one binder or at least one flux. It very advantageously comprises 100 wt. % of said guanidine nitrate, basic copper nitrate, at least one inorganic titanate, at least one processing additive and at least one flux. The blocks of the invention that have this very advantageous composition are generally obtained by dry processing.

Whatever their precise characteristics—thickness and diameter above 10 mm, porosity below 5% and composition constituted to at least 94 wt. % of guanidine nitrate, basic copper nitrate and at least one inorganic (refractory) titanate, present in the proportions stated—the blocks of the invention may, on at least one part of their surface, be inhibited against combustion (covered with a layer of suitable material (combustion inhibiting material), which is generally in the form of a (incombustible) varnish). Such inhibition is a conventional means (notably described in patent application FR 2 275 425 and U.S. Pat. No. 5,682,013) that makes it possible to slow their combustion (already "intrinsically" slow) and therefore obtain very long combustion times (see the 2 min stated above).

On reading the foregoing, a person skilled in the art will appreciate the benefits of the blocks of the invention, whose characteristics of size, porosity and composition enable them to satisfy the stringent requirements of the specifications presented above. In support of this assertion, we may consider the results stated in the examples hereunder.

The blocks of the invention may be obtained by conventional methods, by a wet process or a dry process. It is to be understood that the original composition of said blocks accounts for their advantageous properties, and also allows them to be obtained in advantageous conditions.

The blocks of the invention are advantageously obtained by a dry process. The high content of guanidine nitrate in their composition was emphasized above.

Such a dry process may roughly be summarized as a compression of the pulverulent mixture obtained by mixing the constituents of the blocks (three essential constituents and optionally, in addition, at least one other ingredient; advantageously, three essential constituents+at least one processing additive and optionally at least one flux), said ingredients being used, conventionally, in the pulverulent state. The pressure applied on the pulverulent mixture arranged in a suitable mold is generally between $10^8$ and $6.5\times10^8$ Pa.

Such a dry process may comprise several steps, which were notably described in patent application WO 2006/134311. The first step is a step of (dry) compacting of a mixture of some powdered constituents or of the powdered constituents of the blocks (all the constituents (advantageously, the three essential constituents+at least one processing additive and optionally at least one flux) may be mixed or all except the at least one titanate (therefore advantageously, GN+BCN+at least one processing additive and optionally at least one flux) (see below)). Dry compacting is generally carried out, in a manner known per se, in a roll compactor, at a compacting pressure between $10^8$ and $6.10^8$ Pa. At the end of said compacting step, it is so generally obtained a flat plate (when two rolls with a flat surface are used) or a plate with protuberances (when one of said rolls used has a surface with protuberances). The second step is a step of granulation of the compacted material obtained (therefore generally a flat plate or a plate with protuberances). The granules obtained generally have a grain size (a median diameter) between 200 and 1000 μm (as well as an apparent density between 0.7 and 1.2 g/cm$^3$). The third step is a (dry) compression step (=shaping step) of the granules obtained. The pressure applied is generally between $10^8$ and $6.5\times10^8$ Pa. The at least one titanate is present with the other constituents of the blocks of the invention—GN+BCN mainly, or even exclusively—i.e. at the start of the method for manufacturing the blocks of the invention, or is added, further downstream in the manufacturing method, to the granules, before carrying out compression. It would not be ruled out completely for it to be added in several times, at the start (to the mixture of powders) and further downstream (to the granules).

The (conventional) dry processes described above are employed, in the context of the present invention, to obtain blocks that have the characteristics of composition, size and porosity explained above (i.e. notably a thickness to be burnt greater than or equal to 10 mm, generally between 10 and 100 mm, advantageously between 20 and 80 mm).

In this context of obtaining blocks of the invention by a dry process, the guanidine nitrate (GN) and basic copper nitrate (BCN) used (in the form of powder) advantageously have a fine grain size (value of the median diameter), less than or equal to 20 μm. Said grain size is generally between 1 and 20 μm. These are in fact conventional grain sizes.

The blocks of the invention may also be obtained by a wet process.

According to one variant, said wet process comprises extruding a paste containing all the constituents of the block (advantageously, guanidine nitrate, basic copper nitrate, the at least one titanate, at least one processing additive and at least one binder) and a solvent (water being the preferred "solvent").

According to another variant, said wet process comprises:

a) a step of preparing an aqueous solution of at least one of the essential constituents (generally of at least the reducing charge: GN) and optionally of preparing a suspension of at least one other of said essential constituents that is not soluble (generally of at least the oxidizing charge: BCN) in said solution, then b) obtaining a powder from said solution or suspension by spray-drying, optionally c) adding, to said powder, the constituent or constituents that was/were not previously put in solution or suspension (on the assumption that all the ingredients were not), finally d) shaping the pulverulent mixture thus obtained (=powder obtained at the end of spray-drying or powder obtained at the end of spray-drying added with said complementary constituent or constituents=powder containing all the constituents of the required block) for generating a block;

said at least one inorganic titanate being added to the solution or suspension to be spray-dried (atomized) and/or to the spray-dried (atomized) powder (before it is shaped).

The shaping of the pulverulent mixture is generally a conventional compression (by a known dry compression method). Compression pressures from $10^8$ to $6.5\times10^8$ Pa were stated above, but are not in any way limiting.

The (conventional) wet processes stated above are employed in the context of the present invention to obtain blocks that have the characteristics of composition, size and porosity explained above (i.e. notably a thickness to be burnt greater than or equal to 10 mm, generally between 10 and 100 mm, advantageously between 20 and 80 mm).

According to another of its aims, the present invention relates to gas generators containing a gas-generating solid pyrotechnic charge. Characteristically, the gas generators of the invention contain a charge that contains at least one block (gas-generating pyrotechnic monolithic block, of substantially cylindrical shape) of the invention and/or as obtained by the methods reviewed above. Such generators, integrating a pyrotechnic charge containing several blocks of the invention, in an ordered configuration (for example in the form of a stack of several blocks), as opposed to a bulk charge, said (stacks of) blocks being furthermore able to be inhibited on their lateral surface, are quite particularly suitable for pressurization of structures for long, or even very long periods (note the 500 ms to 2 min stated above).

BRIEF DESCRIPTION OF THE DRAWING

FIG. 1 shows the variation of the porosity value as a function of the pressure applied on the material during a compression step, measured in comparison with the composition in example 1 (Ex. 1) according to an embodiment of the invention and with the composition of comparative example A (Ex. A) (according to the teaching of WO 2007/113299).

It is now proposed to illustrate the invention, not in any way limiting.

I. Table 1 below presents 8 examples (Ex.1 to Ex.8) of composition of block of the present invention as well as the characteristics of said compositions evaluated by means of calculations, notably thermodynamic.

The combustion temperature of the composition in example C (1438 K) is still above 1415 K.

The compositions in examples 1 to 8 of the invention contain, characteristically, guanidine nitrate (GN) and basic copper nitrate (BCN), in an unbalanced weight ratio (greater than or equal to 8.5), as well as an inorganic titanate at a percentage by weight greater than or equal to 3% and less than or equal to 12.5%.

The characteristics of the compositions of examples 1 to 8 in Table 1 show that adding strontium titanate ($SrTiO_3$) or calcium titanate ($CaTiO_3$) to a composition based on GN+BCN that is highly unbalanced in oxygen balance (of the type in example C) makes it possible to obtain a low value of combustion temperature (below the threshold of 1415 K stipulated in the specifications (see above)) while maintaining a high gas yield (greater than or equal to 39.5 mol/kg).

Regarding the rates of combustion, reference may be made to paragraph II below.

TABLE 1

| Examples | | Ex. A | Ex. B | Ex. C | Ex. 1 | Ex. 2 | Ex. 3 | Ex. 4 | Ex. 5 | Ex. 6 | Ex. 7 | Ex. 8 |
|---|---|---|---|---|---|---|---|---|---|---|---|---|
| Ingredients | | | | | | | | | | | | |
| Guanidine Nitrate (GN) | % | 52.44 | 52 | 87.31 | 85 | 82.7 | 80.3 | 85 | 82.7 | 80.3 | 78.2 | 86.9 |
| Basic Copper Nitrate (BCN) | % | 44.87 | 44 | 10 | 9.8 | 9.6 | 9.5 | 9.8 | 9.6 | 9.5 | 9.1 | 9.9 |
| Alumina ($Al_2O_3$) | % | 2.69 | — | 2.69 | — | — | — | — | — | — | — | |
| Ca Stearate | % | — | — | — | 0.2 | 0.2 | 0.2 | 0.2 | 0.2 | 0.2 | 0.2 | 0.2 |
| Strontium titanate ($SrTiO_3$) | % | — | 4 | — | 5 | 7.5 | 10 | — | — | — | — | 3 |
| Calcium titanate ($CaTiO_3$) | % | — | — | — | — | — | — | 5 | 7.5 | 10 | 12.5 | |
| Characteristics | | | | | | | | | | | | |
| Weight ratio (R) GN/BCN | | 1.2 | 1.2 | 8.7 | 8.7 | 8.6 | 8.5 | 8.7 | 8.6 | 8.5 | 8.6 | 8.8 |
| Oxygen balance | % | −3.3 | −3.3 | −20.5 | −20.4 | −19.8 | −19.1 | −20.4 | −19.7 | −19.0 | −18.5 | −20.9 |
| Combustion temperature | K | 1905 | 1889 | 1438 | 1398 | 1377 | 1358 | 1411 | 1396 | 1382 | 1364 | 1414 |
| Density | g/cm$^3$ | 1.99 | 2.01 | 1.55 | 1.58 | 1.61 | 1.64 | 1.58 | 1.60 | 1.63 | 1.66 | 1.56 |
| Gas yield at 1bar - 1000 K | mol/kg | 29.5 | 29.2 | 43.7 | 42.8 | 41.6 | 40.5 | 42.8 | 41.6 | 40.5 | 39.5 | 43.8 |

These compositions and their characteristics are to be compared with those of examples A, B and C, given for comparison:

- the composition in example A is a composition according to the teaching of WO 2007/113299. It contains 52.44 wt. % of GN and 44.87 wt. % of BCN (ratio R=GN/BCN (=1.2) is close to the stoichiometric equilibrium). It also contains 2.69 wt. % of alumina (slagging agent (according to WO 2007/113299));
- the composition in example B is a composition "according to the teaching of WO 2007/113299" (see its contents of GN and BCN, close to the stoichiometric equilibrium (R=1.2)) which further contains 4 wt. % of strontium titanate;
- the composition in example C is an unbalanced GN+BCN base composition (R=GN/BCN=8.7). Besides GN and BCN, said composition contains alumina (slagging agent) at a level identical to that of the composition of example A.

The compositions of said examples A, B and C have combustion temperatures above 1415 K.

It is noted that the presence of strontium titanate in a composition having an almost equilibrated oxygen balance (close to zero) has hardly any effect on the combustion temperature (see the values of said combustion temperature for the compositions in examples A (1905 K) and B (1889 K)).

II. The combustion rates of blocks of the invention were compared with those of blocks according to the teaching of WO 2007/113299.

In fact:

- the combustion rates measured at 2 MPa and at 0.1 MPa were measured on blocks (with a diameter: 24.6 mm and a thickness: 10 mm) having, respectively, the composition of example 8 according to the invention and the composition of example A (according to WO 2007/113299) in Table 1 above, and
- the combustion rates at 20 MPa (high pressure) were measured on pellets (with a diameter: 6.35 mm and a thickness: 2 mm) having, respectively, the composition of example 8 according to the invention and the composition of example A (according to WO 2007/113299) in Table 1 above. This is purely a suitable geometry for measuring the combustion rate at high pressure.

The blocks and pellets were obtained by the same dry process (compacting+granulation+compression), carried out in the same conditions (notably the same compacting and compression pressure), so that the combustion rates measured are comparable.

These measured combustion rates are presented in Table 2 below.

The porosities of said blocks and pellets obtained in said same conditions are stated below:

| | Block | Pellet |
|---|---|---|
| Ex. A (porosities above 3%) | 4.5% | 4.0% |
| Ex. 8 (porosities below 3%) | 1.5% | 0.5% |

TABLE 2

| Characteristics | | Examples | |
|---|---|---|---|
| | | Ex. A | Ex. 8 |
| Combustion rate at 10 MPa | mm/s | 16 | 5 |
| Combustion rate at 2 MPa | mm/s | 8 | 2 |
| Combustion rate at 0.1 MPa | mm/s | 1 | 0.4 |
| Agglomerated appearance of the combustion residues (in the form of a skeleton of the pyrotechnic block) | — | yes | yes |

The above results show that the pyrotechnic block according to the invention has combustion rates (at 2 MPa and at 0.1 MPa) that are very significantly lower than those of the block of the prior art. The same applies to the rate of combustion, at 10 MPa, measured on the pellets.

Moreover, it was found that the block according to the invention, despite the considerable imbalance of the GN/BCN ratio in its composition, advantageously displays self-sustaining combustion up to the minimum value desired (i.e. up to atmospheric pressure).

III. In the following, the densification characteristics of the compositions of the blocks of the invention are now considered. These densification characteristics are significantly improved relative to those of the compositions according to the teaching of WO 2007/113299. These densification characteristics notably allow the obtaining of blocks with very low porosity (<5%, advantageously ≤3%, very advantageously ≤2%, or even ≤1%).

The accompanying FIG. 1 shows the densification curves (i.e. the variation of the porosity value as a function of the pressure applied on the material during a compression step), measured in comparison with the composition in example 1 (Ex. 1) according to the invention and with the composition of comparative example A (Ex. A) (according to the teaching of WO 2007/113299). These densification curves were established in a context of manufacture of pellets (dry process: compacting+granulation+compression), with different values of the compression force. The value of compression force applied is then translated into an equivalent value of material pressure according to the following equation: Material pressure (in bar; abscissa)=compression force applied (in N) divided by the surface area of the imprint of the compression punch (in $m^2$) divided by $10^5$. The porosity value (ordinate) is calculated from measurement of the dimensions (thickness, diameter) and weight of the pellet (tablet) obtained (it is expressed as a percentage; it corresponds to the difference between the theoretical density value and the measured density value, relative to the theoretical density value (see above)).

For values of pressure above 3000 bar, the composition according to example 1 of the invention allows pellets to be obtained, characterized by a porosity value less than or equal to 1%, i.e. very close to the maximum densification. For one and the same value of pressure applied (3000 bar), the measured porosity value for pellets according to the prior art is significantly higher (of the order of 5%).

A person skilled in the art knows that it is advantageous to be able to limit the compression force, as this contributes favorably to reducing the mechanical stresses (fatigue, wear) applied on the tooling. This compression force is greater for larger dimensions of the object to be compressed. In the context of the present invention, the manufacture of monolithic blocks of large diameter (for example 38 mm) and with thickness of 20 mm (such as is required for certain intended applications) then requires applying a high compression force in order to guarantee the obtaining of a value of densification as close as possible to the maximum theoretical density value.

According to the curves in FIG. 1, the obtaining of a porosity value less than or equal to 4% for the composition according to comparative example A requires a high value of material pressure, of the order of 4000 bar, that is to say an equivalent compression force of the order of 45 tonnes. In comparison, a porosity value less than or equal to 4% (or preferably less than or equal to 3%) for the composition according to the invention (example 1) is obtained for a significantly lower value of material pressure, of the order of 1000 bar (1500 bar), that is to say an equivalent compression force of the order of 11 tonnes (17 tonnes). Thus, the composition according to example 1 of the present invention advantageously makes it possible either to reduce the compression force significantly (for one and the same intended level of porosity), or obtain a lower value of porosity (for one and the same level of compression force applied).

These advantageous characteristics of densification shown on pellets are of course transposable to blocks (of the invention).

The invention claimed is:

1. A gas-generating pyrotechnic monolithic block, of substantially cylindrical shape, wherein:

the gas-generating pyrotechnic monolithic block has a thickness greater than or equal to 10 mm, an equivalent diameter greater than or equal to 10 mm, and a porosity below 5%; and wherein a composition of the gas-generating pyrotechnic monolithic block, expressed in percentage by weight, contains, for at least 94% of its weight:

+77.5 to 92.5% of guanidine nitrate,

+5 to 10% of basic copper nitrate, and

+2.5 to 12.5% of at least one inorganic titanate whose melting point is above 2100 K.

2. The block as claimed in claim 1, whose thickness is between 10 and 100 mm and/or whose equivalent diameter is between 10 and 100 mm.

3. The block as claimed in claim 1, whose porosity is less than or equal to 2%.

4. The block as claimed in claim 1, wherein the composition of the gas-generating pyrotechnic monolithic block contains said guanidine nitrate and said basic copper nitrate in a ratio, R, between 8.5 and 15 (8.5≤R≤15).

5. The block as claimed in claim 1, wherein said at least one inorganic titanate consists of at least one inorganic titanate selected from the group consisting of metal titanates and alkaline-earth titanates.

6. The block as claimed in claim 1, wherein said at least one inorganic titanate consists of strontium titanate ($SrTiO_3$) and/or calcium titanate ($CaTiO_3$) and/or aluminum titanate ($Al_2TiO_5$).

7. The block as claimed in claim 1, wherein said guanidine nitrate, basic copper nitrate and at least one inorganic titanate represent at least 97 wt % of its weight.

8. The block as claimed in claim 1, wherein the composition of the gas-generating pyrotechnic monolithic block contains, in addition to said guanidine nitrate, basic copper nitrate and at least one inorganic titanate, at least one processing additive, in a proportion by weight not exceeding 1%.

9. The block as claimed in claim 1, wherein the composition of the gas-generating pyrotechnic monolithic block contains, in addition to said guanidine nitrate, basic copper nitrate and at least one inorganic titanate, at least one binder or at least one flux, in a proportion by weight not exceeding 5%.

10. The block as claimed in claim 1, wherein the composition of the gas-generating pyrotechnic monolithic block contains, for 100% of its weight:

said guanidine nitrate,
said basic copper nitrate,
said at least one inorganic titanate, and
at least one processing additive.

11. The block as claimed in claim 1, wherein the composition of the gas-generating pyrotechnic monolithic block contains, for 100% of its weight:

said guanidine nitrate,
said basic copper nitrate,
said at least one inorganic titanate,
at least one processing additive, and
at least one binder or at least one flux.

12. A method for obtaining a gas-generating pyrotechnic monolithic block, of substantially cylindrical shape, as claimed in claim 1, wherein the method consists of a dry process or a wet process.

13. The method as claimed in claim 12, wherein the method consists of a dry process, which comprises:

compressing a pulverulent mixture containing said guanidine nitrate, said basic copper nitrate, said at least one inorganic titanate, at least one processing additive and optionally at least one flux; or compacting a pulverulent mixture containing said guanidine nitrate, said basic copper nitrate, at least one processing additive and optionally at least one melting agent for obtaining a compacted material, followed by granulating said compacted material to obtain granules, followed by compressing said granules; said at least one inorganic titanate being added to the pulverulent mixture to be compacted and/or to the granules to be compressed.

14. The method as claimed in claim 12, wherein the method consists of a wet process, which comprises:

extruding a paste containing said guanidine nitrate, said basic copper nitrate, said at least one inorganic titanate, at least one processing additive, at least one binder and a solvent; or preparing an aqueous solution containing at least said guanidine nitrate, optionally suspending at least basic copper nitrate in said aqueous solution, obtaining a powder by spray-drying said solution or suspension, if necessary adding complementary constituent(s) of said block to said powder and shaping the powder, optionally added with said complementary constituent(s), containing all the constituents of said block; said at least one inorganic titanate being added to the solution or suspension to be spray-dried and/or to the spray-dried powder.

15. A gas generator, containing a gas-generating solid pyrotechnic charge, wherein said charge contains at least one block as claimed in claim 1.

16. The block as claimed in claim 1, wherein the composition of the gas-generating pyrotechnic monolithic block contains said guanidine nitrate and said basic copper nitrate in a ratio, R, between 8.5 and 12 ($8.5 \leq R \leq 12$).

17. The block as claimed in claim 1, wherein said guanidine nitrate, basic copper nitrate and at least one inorganic titanate represent at least 99 wt. % of its weight.

18. A method as claimed in claim 12, wherein said method consists of a dry process.

19. A gas generator, containing a gas-generating solid pyrotechnic charge, wherein said charge contains at least one block obtained according to the method of claim 12.

* * * * *